US007307602B1

(12) United States Patent
Wedding et al.

(10) Patent No.: US 7,307,602 B1
(45) Date of Patent: Dec. 11, 2007

(54) PLASMA DISPLAY ADDRESSING

(75) Inventors: Carol Ann Wedding, Toledo, OH (US); Jeffrey W. Guy, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 544 days.

(21) Appl. No.: 10/840,262

(22) Filed: May 7, 2004

Related U.S. Application Data

(63) Continuation-in-part of application No. 10/036,074, filed on Jan. 4, 2002, now abandoned, which is a continuation of application No. 09/759,280, filed on Jan. 16, 2001, now abandoned.

(60) Provisional application No. 60/176,756, filed on Jan. 19, 2000.

(51) Int. Cl.
*G09G 3/28* (2006.01)
*G09G 3/10* (2006.01)

(52) U.S. Cl. ..... 345/61; 345/63; 345/66; 345/690; 315/169.1; 315/169.2; 315/169.4

(58) Field of Classification Search ..... 345/60–69, 345/690–692, 214; 313/296–301; 315/169.1–169.4
See application file for complete search history.

(56) References Cited

U.S. PATENT DOCUMENTS 5,436,634 A * 7/1995 Kanazawa ..... 345/67
6,496,164 B1 * 12/2002 Kuwahara et al. ..... 345/60
6,559,814 B1 * 5/2003 Kanazawa et al. ..... 345/60
6,636,187 B2 * 10/2003 Tajima et al. ..... 345/55

* cited by examiner

*Primary Examiner*—Henry N Tran
(74) *Attorney, Agent, or Firm*—Donald K. Wedding; Jim Zegeer

(57) ABSTRACT

There is disclosed the priming or conditioning of an AC gas discharge plasma display panel for improved selective write and selective erase which comprises addressing n number of rows in an order or sequence that is changed from frame to frame such that later rows to be addressed are advanced in the sequence with each subsequent frame. Each frame consists of the addressing of all n rows. Specific embodiments include the use of plasma-shells, plasma-tubes, and/or combinations thereof.

3 Claims, 6 Drawing Sheets

PLASMA DISPLAY ADDRESSING

RELATED APPLICATIONS

This is a continuation in part under 35 USC 120 of U.S. patent application Ser. No. 10/036,074, filed Jan. 4, 2002 now abandoned, which is a continuation under 35 USC 120 of U.S. patent application Ser. No. 09/759,280, filed Jan. 16, 2001 now abandoned, with a claim of priority under 35 USC 119(e) of Provisional Application 60/176,756, filed Jan. 19, 2000

FIELD OF INVENTION

This invention relates to an AC gas discharge (plasma) display device wherein an ionizable gas is confined within an enclosure and is subjected to sufficient voltage(s) to cause the gas to discharge. This invention particularly relates to the priming or conditioning of the ionizable gas in an AC gas discharge (plasma) display device Examples of gas discharge (plasma) devices contemplated in the practice of this invention include both monochrome (single color) AC plasma displays and multi-color (two or more colors) AC plasma displays.

BACKGROUND

PDP Structures and Operation

In a gas discharge plasma display panel (PDP), a single addressable picture element is a cell, sometimes referred to as a pixel. The cell element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell or pixel.

To form a display image, several types of voltage pulses may be applied across a plasma display cell gap. These pulses include a write pulse, which is the voltage potential sufficient to ionize the gas at the pixel site. A write pulse is selectively applied across selected cell sites. The ionized gas will produce visible light, or UV light which excites a phosphor to glow. Sustain pulses are a series of pulses that produce a voltage potential across pixels to maintain ionization of cells previously ionized. An erase pulse is used to selectively extinguish ionized pixels.

The voltage at which a pixel will ionize, sustain, and erase depends on a number of factors including the distance between the electrodes, the composition or mixture of the ionizing gas, and the pressure of the ionizing gas. The gas must also be primed or conditioned. Also of importance is the dielectric composition and thickness. To maintain uniform electrical characteristics throughout the display it is desired that the various physical parameters adhere to required tolerances. Maintaining the required tolerance depends on cell geometry, fabrication methods and the materials used. The prior art discloses a variety of plasma display structures, a variety of methods of construction, and materials.

Examples of open cell gas discharge (plasma) devices include both monochrome (single color) AC plasma displays and multi-color (two or more colors) AC plasma displays. Also monochrome and multicolor DC plasma displays are contemplated.

Examples of monochrome AC gas discharge (plasma) displays are well known in the prior art and include those disclosed in U.S. Pat. No. 3,559,190 issued to Bitzer et al., U.S. Pat. No. 3,499,167 (Baker et al), U.S. Pat. No. 3,860,846 (Mayer) U.S. Pat. No. 3,964,050 (Mayer), U.S. Pat. No. 4,080,597 (Mayer), U.S. Pat. No. 3,646,384 (Lay) and U.S. Pat. No. 4,126,807 (Wedding), all incorporated herein by reference.

Examples of multicolor AC plasma displays are well known in the prior art and include those disclosed in U.S. Pat. No. 4,233,623 issued to Pavliscak, U.S. Pat. No. 4,320,418 (Pavliscak), U.S. Pat. No. 4,827,186 (Knauer, et al.), U.S. Pat. No. 5,661,500 (Shinoda et al.), U.S. Pat. No. 5,674,553 (Shinoda, et al.), U.S. Pat. No. 5,107,182 (Sano et al.), U.S. Pat. No. 5,182,489 (Sano), U.S. Pat. No. 5,075,597 (Salavin et al), U.S. Pat. No. 5,742,122 (Amemiya, et al.), U.S. Pat. No. 5,640,068 (Amemiya et al.), U.S. Pat. No. 5,736,815 (Amemiya), U.S. Pat. No. 5,541,479 (Nagakubi), U.S. Pat. No. 5,745,086 (Weber) and U.S. Pat. No. 5,793,158 (Wedding), all incorporated herein by reference.

This invention may be practiced in a DC gas discharge (plasma) display which is well known in the prior art, for example as disclosed in U.S. Pat. No. 3,886,390 (Maloney et al.), U.S. Pat. No. 3,886,404 (Kurahashi et al.), U.S. Pat. No. 4,035,689 (Ogle et al.) and U.S. Pat. No. 4,532,505 (Holz et al.), all incorporated herein by reference.

This invention will be described with reference to an AC plasma display. The PDP industry has used two different AC plasma display panel (PDP) structures, the two-electrode columnar discharge structure and the three-electrode surface discharge structure. Columnar discharge is also called co-planar discharge.

Columnar PDP

The two-electrode columnar or co-planar discharge plasma display structure is disclosed in U.S. Pat. No. 3,499,167 (Baker et al) and U.S. Pat. No. 3,559,190 (Bitzer et al.) The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding 158, each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Pat. Nos. 5,661,500 and 5,674,553, both issued to Tsutae Shinoda et al of Fujitsu Limited; U.S. Pat. No. 5,745,086 issued to Larry F. Weber of Plasmaco and Matsushita; and U.S. Pat. No. 5,736,815 issued to Kimio Amemiya of Pioneer Electronic Corporation, all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

Single Substrate PDP

There may be used a PDP structure having a so-called single substrate or monolithic plasma display panel structure having one substrate with or without a top or front viewing envelope or dome. Single-substrate or monolithic plasma display panel structures are well known in the prior art and are disclosed by U.S. Pat. Nos. 3,646,384 (Lay), 3,652,891 (Janning), 3,666,981 (Lay), 3,811,061 (Nakayama et al), 3,860,846 (Mayer), 3,885,195 (Amano), 3,935,494 (Dick et al), 3,964,050 (Mayer), 4,106,009 (Dick), 4,164,678 (Biazzo et al), and 4,638,218 (Shinoda), all incorporated herein by reference.

RELATED PRIOR ART SPHERES, BEADS, AMPOULES, CAPSULES

The following prior art references are incorporated herein by reference.

U.S. Pat. No. 2,644,113 (Etzkorn) discloses ampoules or hollow glass beads containing luminescent gases that emit a colored light. In one embodiment, the ampoules are used to radiate ultra violet light onto a phosphor external to the ampoule itself.

U.S. Pat. No. 3,848,248 (MacIntyre) discloses the embedding of gas filled beads in a transparent dielectric. The beads are filled with a gas using a capillary. The external shell of the beads may contain phosphor.

U.S. Pat. No. 4,035,690 (Roeber) discloses a plasma panel display with a plasma forming gas encapsulated in clear glass spheres. Roeber used commercially available glass spheres containing gases such as air, $SO_2$ or $CO_2$ at pressures of 0.2 to 0.3 atmosphere. Roeber discloses the removal of these residual gases by heating the glass spheres at an elevated temperature to drive out the gases through the heated walls of the glass sphere. Roeber obtains different colors from the glass spheres by filling each sphere with a gas mixture which emits a color upon discharge and/or by using a glass sphere made from colored glass.

Japanese Patent 11238469A, published Aug. 31, 1999, by Tsuruoka Yoshiaki of Dainippon discloses a plasma display panel containing a gas capsule. The gas capsule is provided with a rupturable part which ruptures when it absorbs a laser beam.

U.S. Pat. No. 6,545,422 (George et al) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

Other George et al prior art include U.S. Pat. Nos. 6,646,388 (George et al), 6,620,012 (Johnson et al), 6,612,889 (Green et al), and 6,570,335 (George et al), all incorporated herein by reference.

Published patent applications by George et al include U.S. patent applications 2004/0004445 (George et al), 2003/0164684 (Green et al), 2003/0094891 (Green et al), and 2003/0090213 (George et al), all incorporated herein by reference.

RELATED PRIOR ART PDP TUBES

The following prior art references relate to the use of tubes in a PDP and are incorporated herein by reference.

U.S. Pat. No. 3,602,754 (Pfaender et al.) discloses a multiple discharge gas display panel in which filamentary or capillary size glass tubes are assembled and formed as a monolayer to form a gas discharge panel.

U.S. Pat. Nos. 3,654,680 (Bode et al), 3,927,342 (Bode et al) and 4,038,577 (Bode et al) disclose a gas discharge display in which filamentary or capillary size gas tubes are assembled to form a gas discharge panel.

U.S. Pat. No. 3,969,718 (Strom) discloses a plasma display system utilizing tubes arranged in a side by side, parallel fashion.

U.S. Pat. No. 3,990,068 (Mayer et al) discloses a capillary tube plasma display with a plurality of capillary tubes arranged parallel in a close pattern.

U.S. Pat. No. 4,027,188 (Bergman) discloses a tubular plasma display consisting of parallel glass capillary tubes sealed in a plenum and attached to a rigid substrate.

U.S. Pat. No. 5,984,747 (Bhagavatula et al.) discloses rib structures for containing plasma in electronic displays are formed by drawing glass performs into fiber-like rib components. The rib components are then assembled to form rib/channel structures suitable for flat panel displays.

U.S. patent application 2001/0028216A1 (Tokai et al.) discloses a group of elongated illuminators in a gas discharge device.

U.S. Pat. No. 6,255,777 (Kim et al) and U.S. patent application 2002/0017863 (Kim et al) of Plasmion disclose a capillary electrode discharge PDP device and a method of fabrication.

U.S. Pat. No. 6,545,422 (George et al) discloses a PDP with a plurality of micro-components in a socket and sandwiched between two substrates.

Other George et al prior art include U.S. Pat. Nos. 6,646,388 (George et al), 6,620,012 (Johnson et al), 6,612,889 (Green et al), and 6,570,335 (George et al), all incorporated herein by reference.

Published patent applications by George et al include U.S. patent applications 2004/0004445 (George et al), 2003/0164684 (Green et al), 2003/0094891 (Green et al), and 2003/0090213 (George et al), all incorporated herein by reference.

U.S. Pat. Nos. 6,633,117 (Shinoda et al), 6,650,055 (Ishimoto et al), and 6,677,704 (Ishimoto et al), disclose a PDP with elongated display tubes, all incorporated herein by reference.

European Patent 1,288,993 (Ishimoto et al), also discloses a PDP with elongated display tubes and is incorporated herein by reference.

The following U.S. patent application by Fujitsu Ltd. of Kawasaki disclose PDP structures with elongated display tubes and are incorporated by reference:

US 2004/0033319 (Yamada et al),
US 2003/0214223 (Ishimoto et al),
US 2003/0214224 (Awamoto et al)
US 2003/0214225 (Yamada et al),
US 2003/0184212 (Ishimoto et al),
US 2003/0182967 (Tokai et al),
US 2003/0180456 (Yamada et al),
US 2003/0122485 (Tokai et al),
US 2003/0052592 (Shinoda et al),
US 2003/0049990 (Yamada et al),
US 2003/0048077 (Ishimoto et al),
US 2003/0048068 (Yamada et al),
US 2003/0042839 (Ishimoto et al),
US 2003/0025451 (Yamada et al),
US 2003/0025440 (Ishimoto et al).

RELATED PRIOR ART PDP PRIMING AND CONDITIONING

It is known in the prior art that the ionizable gas in a gas discharge plasma display must be primed or conditioned in order to obtain a gas discharge. This priming or conditioning has been defined in the prior art as providing a source of free electrons or photon fluxing for initiation of the discharge.

In DC gas discharge plasma displays, auxiliary energizing cells have been provided for conditioning as disclosed in U.S. Letters Reissue Pat. No. 28,683 (Kupsky) and U.S. Pat. No. 3,654,507 (Caras et al.). In AC gas discharge plasma, conditioning has been done by the use of pilot electrodes or a radioactive material as disclosed in U.S. Pat. No. 3,928,781 (Edwards et al.). Pilot lights are also disclosed in U.S. Pat. No. 3,609,658 (Soltan). These pilot lights have also been called "keep-alive" cells as disclosed in U.S. Pat. No. 3,979,638 (Ngo) and 4,009,415 (Ngo).

Wide border conditioning electrodes have been used as disclosed in U.S. Pat. No. 3,878,420 (Fein et al.).

In U.S. Pat. No. 3,982,155 (Fein), the sustaining voltage to the pilot cells is greater in amplitude than the sustaining voltage applied to the other display cells (or pixels) so as to provide a conditioning photon flux.

High amplitude sustainer pulses have also been applied to conditioning cells or pixels as disclosed in U.S. Pat. Nos. 3,833,831 (Petty et al.) and 3,843,905 (Leuck et al.).

Other conditioning prior art includes:

IBM technical Disclosure Bulletin, Vol. 15, No. 8, January 1973, pages 2514, 2515.

IBM technical Disclosure Bulletin, Vol 20, NO. 3, August 1977, pages 1063 to 1068.

SUMMARY OF INVENTION

The invention relates to the priming or conditioning of an AC gas discharge plasma display panel for improved selective write and selective erase which comprises scanning n number of rows (row electrodes) in an order or sequence that is changed from frame to frame such that later rows to be scanned are advanced in the sequence with each subsequent scan.

DESCRIPTION OF THE INVENTION

This invention relates to an AC plasma display device comprising an AC gas discharge plasma display panel (PDP) and electronic means to apply voltage potential at selected cell sites. As used herein the term cell also means pixel. In a monochrome (single color) plasma display, each gas discharge (plasma) site is called a cell, pixel, or pel. In a multiple color plasma display, two or more discharge sites (each exiting a different phosphor) form a cell, pixel or pel. Each of the multiple discharge sites may also be called a cell, pixel, pel, sub-cell, sub-pixel or sub-pel. As used herein, the term cell means any of the above including pixel, pel, sub-cell, sub-pixel, or sub-pel.

Cell sites are formed by the configuration of the electrodes. In DC PDP there are opposing orthogonal arrays of parallel electrodes, one array consisting of data electrodes and the opposing array consisting of scan electrodes, the crossover or intersection of a data electrode and an opposing orthogonal scan electrode forming a cell site. These electrodes are in direct contact with an ionizable gas. When a voltage potential is applied to a single pair of data and scan electrodes, the ionizable gas is excited and produces a gas discharge. The gas discharge may emit light in the visible region or emit UV light that excites a phosphor so as to cause the phosphor to emit light. Examples of DC PDP are disclosed in U.S. Pat. No. 3,886,390 (Maloney et al.), U.S. Pat. No. 3,886,404 (Kurahashi et al.), U.S. Pat. No. 4,035,689 (Ogle et al.) and U.S. Pat. No. 4,532,505 (Holz et al.), all incorporated herein by reference.

An AC PDP differs from a DC PDP in that at least one electrode at the cell site in a AC PDP is covered by a dielectric material and is not in direct contact with the ionizable gas. The PDP industry typically uses an AC PDP with a surface discharge structure, for example, as disclosed by U.S. Pat. Nos. 5,661,500 and 5,674,553 (Shinoda et al) cited above and incorporated herein by reference, for a color AC gas discharge (plasma) display. In the referenced Shinoda patents, two parallel electrodes on a front substrate act to produce a sustain voltage and an orthogonal column data electrode on the rear substrate provides the write and erase voltage pulses.

In the preferred embodiment of this invention, there is used a surface discharge AC PDP structure. In other embodiments of this invention, there is used a surface discharge AC PDP constructed of a multiplicity of microspheres and/or elongated tubes of any suitable geometric cross-section or volumetric configuration including flattened or partially flattened bodies such as discs and domes. The AC PDP may comprise dual (opposing) substrates or may be on a single (monolithic) substrate.

Figure 1:
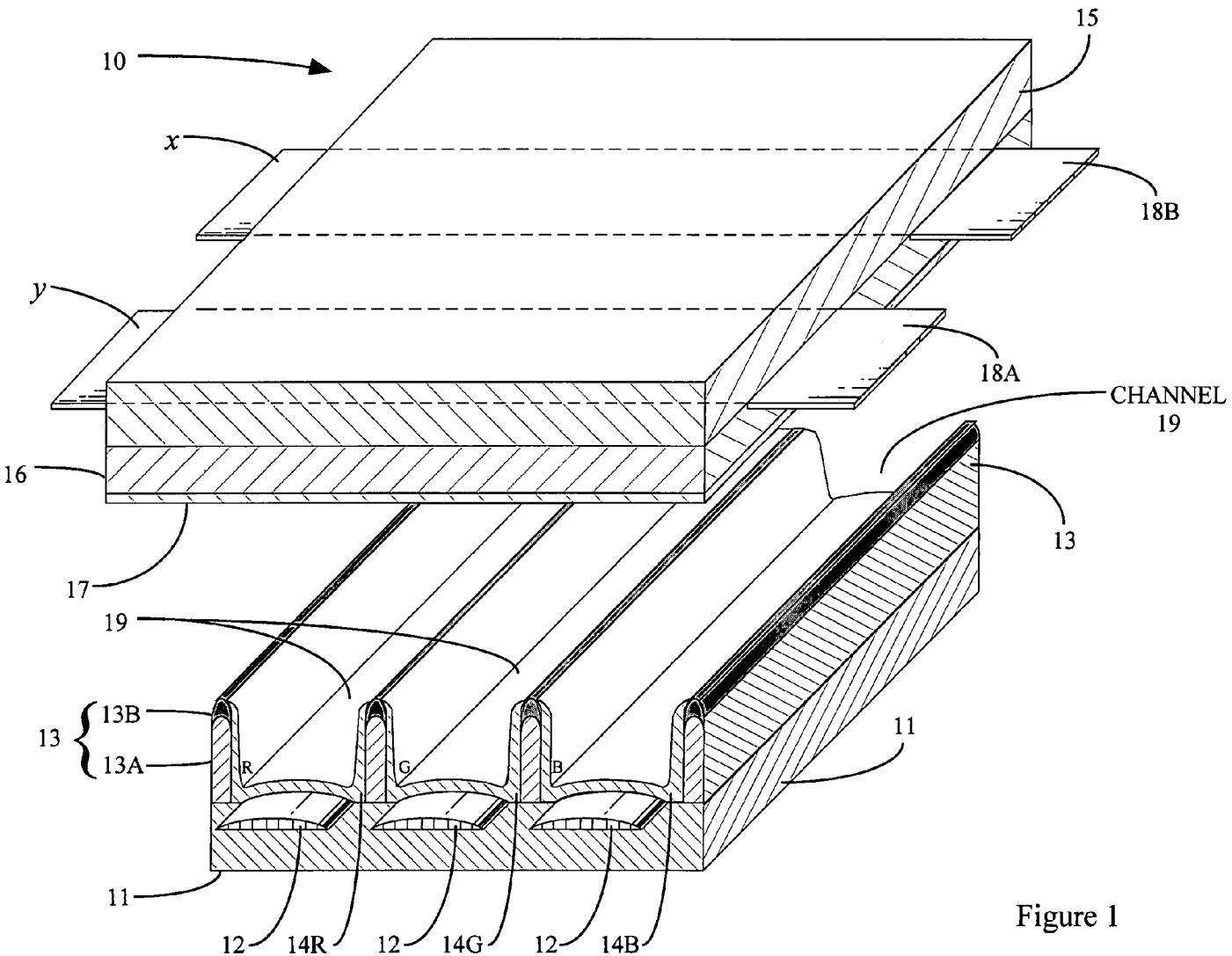
FIG. 1 shows a prospective view of an AC gas discharge (plasma) display panel with dual or opposing substrates.
Figure 2:
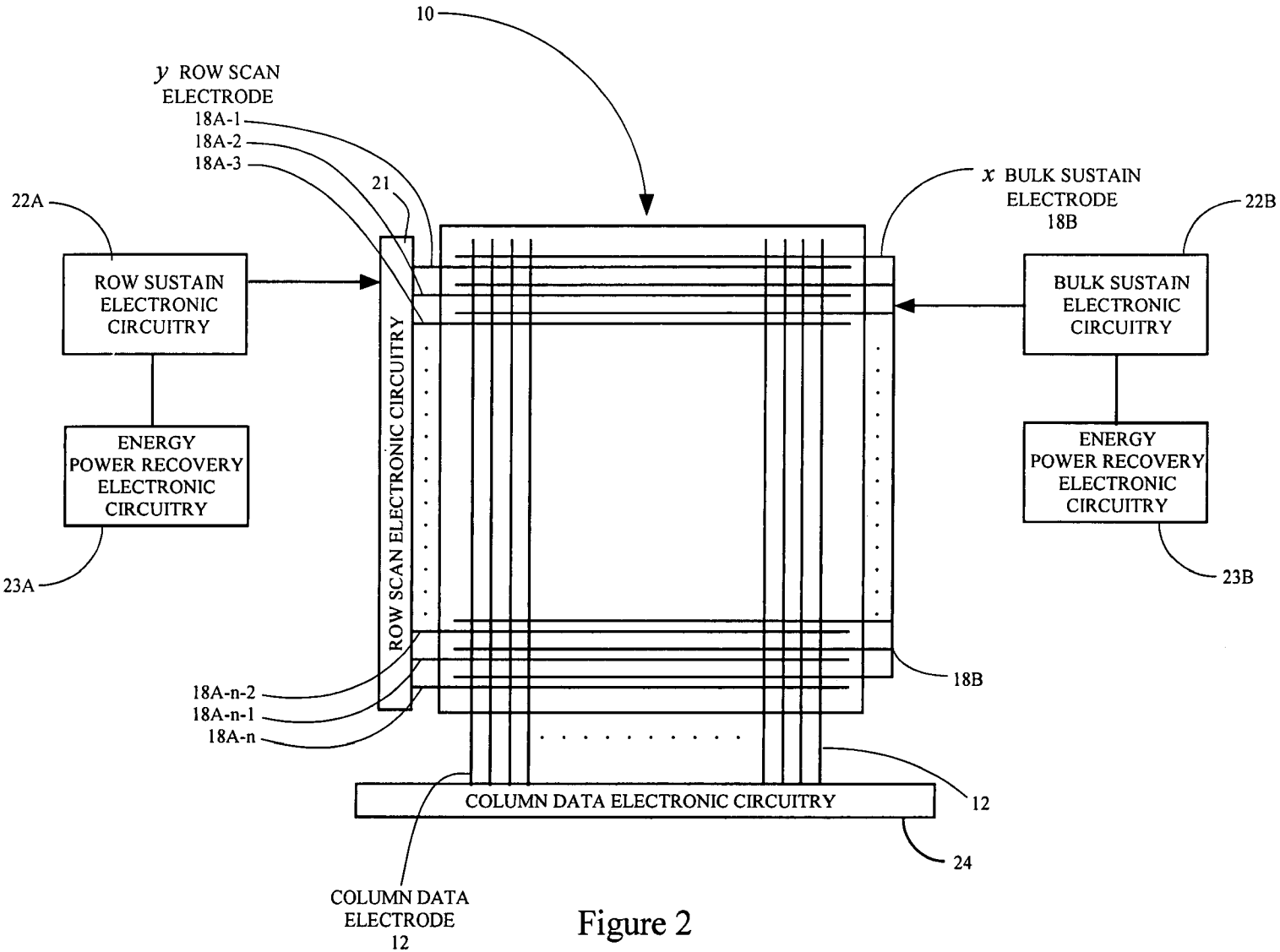
FIG. 2 shows a block diagram of electronics for driving an AC gas discharge plasma display.

FIG. 1 shows a dual substrate surface discharge AC gas discharge plasma display panel structure 10 similar to the structure illustrated and described in FIG. 2 of U.S. Pat. No. 5,661,500 (Shinoda et al.) cited above and incorporated herein by reference. The panel structure 10 has a bottom or rear glass substrate 11 and a top substrate 15.

The bottom substrate 11 contains electrodes 12, barriers 13 and phosphor 14R, 14G, 14B. Each barrier 13 comprises a bottom portion 13A and a top portion 13B. The top portion 13B is dark or black for increased contrast ratio. The bottom portion 13A may be translucent, opaque, dark, or black.

The top substrate 15 is transparent glass for viewing and contains y row scan electrode 18A and x bulk sustain electrode 18B, dielectric layer 16 covering the electrodes 18A and 18B, and a magnesium oxide layer 17 covering the surface of dielectric 16. The magnesium oxide is for secondary ion emission and decreases the overall operating voltage of the display.

A plurality of channels 19 are formed by the barriers 13 and phosphor 14. When the two substrates 11 and 15 are sealed together, an ionizable gas mixture is introduced into the channels 19. This is typically a Penning mixture of the rare gases such as neon, argon, xenon, krypton, and/or helium.

Each electrode 12 on the bottom substrate 11 is called a column data electrode. The y electrode 18A on the top substrate 15 is the row scan electrode and the x electrode 18B on the top substrate 15 is the bulk sustain electrode. The gas discharge is initiated by voltages applied between a bottom column data electrode 12 and a top y row scan electrode 18A. The sustaining of the resulting discharge is done between an electrode pair of the top y row scan electrode 18A and a top x bulk sustain electrode 18B. Each pair of the y and x electrodes is a row.

Phosphor 14R emits red luminance when excited by photons from the gas discharge within the plasma panel. Phosphor 14G emits green luminance when excited by photons from the gas discharge within the plasma panel. Phosphor 14B emits blue luminance when excited by photons for the gas discharge within the plasma panel. The phosphors may be selected from inorganic and/or organic luminescent substances including mixtures of luminescent substances.

The row scan electrode 18A and the bulk sustain electrode 18B may each be a transparent material such as tin oxide or indium tin oxide (ITO) with a thin conductive ribbon or bus bar along one edge. The ribbon may be any conductive material including gold, silver, chrome-copper chrome, or like material.

The drive system for an AC plasma display includes electronic circuitry for applying write voltage pulses, erase voltage pulses, and sustain voltage pulses in a selectable fashion to one or more cells. A write pulse at a cell cite causes the gas to discharge and emit light. An erase pulse causes the plasma to extinguish. A sustain pulse causes a cell previously written to continue to emit light until subjected to an erase pulse.

A basic electronic architecture for applying voltages to the three electrodes 12, 18A, 18B is disclosed in U.S. Pat. Nos. 5,661,500 and 5,674,553 (Shinoda et al) and U.S. Pat. No. 5,446,344 (Yoshikazu Kanazawa of Fujitsu), incorporated herein by reference. This basic architecture is widely used in the PDP industry for addressing and sustaining AC gas discharge (plasma) displays and has been labeled by Fujitsu as ADS (Address Display Separately). In addition to ADS, other suitable architectures are known in the art and are available for addressing and sustaining the electrodes 12, 18A, and 18B of FIG. 1.

FIG. 2 shows display panel 10 with electronic circuitry 21 for the y row scan electrodes 18A-1, 18A-2, 18A-3, 18A-n, 18A-n−1, 18A-n−2, etc. bulk sustain electronic circuitry 22B for x bulk sustain electrode 18B and column data electronic circuitry 24 for the column data electrodes 12.

There is also shown row sustain electronic circuitry 22A with an energy power recovery electronic circuit 23A. There is also shown energy power recovery electronic circuitry 23B for the bulk sustain electronic circuitry 22B.

The energy recovery architecture and circuits are well known in the prior art. These include U.S. Pat. Nos. 4,772,884 (Weber et al.), 4,866,349 (Weber et al.), 5,081,400 (Weber et al.), 5,438,290 (Tanaka), 5,642,018 (Marcotte), 5,670,974 (Ohba et al.), and 5,739,641 (Nakamura et al.).

In time multiplexed brightness control, the light output of a given cell is proportional to the number of sustains in a given cycle that the cell experiences after it has been written. This time multiplexing is also used to produce cell by cell gray scale.

Selective write is generally accomplished using the following sequence: (1) A global write is applied to all cells to prime the ionizable gas. (2) A global erase is applied to all cells. (3) A selective write is applied to each cell that is to be written on a row by row basis. (4) Global sustains are applied to all cells and for a time proportional to the desired gray level.

Selective erase is generally accomplished using the following sequence: (1) A global erase is applied to all cells (2) A global write is applied to all cells. (3) A selective write is applied to each cell that is to be written on a row by row basis. (4) Global sustains are applied to all cells for a time proportional to the desired gray level.

As used herein, addressing includes writing and/or erasing a cell. Global addressing is the addressing of all cells in the display and includes global write and/or global erase. In AC gas discharge plasma displays, a problem exists in which cells in rows that are addressed a short time after a global address has been applied are easier to address with a write or erase voltage pulse, relative to cells that are addressed a long period of time after the global address is applied. As the same row scan pattern is applied every frame, the result is rows of cells that are subsequently addressed soon after the global address will continually light or erase with ease whereas rows that are addressed a longer time after the global address pulse are more difficult to write or erase and may not write or erase at all. This problem will manifest itself in rows (row electrodes) of the display with cells that do not light or erase inconsistently.

Therefore, in an AC plasma panel with n rows (or row electrodes) and a selective address scheme, the cells become more and more difficult to address as one addresses rows 1 to n. In FIG. 2, these are shown as row electrodes 18A-1 to 18A-n. As stated above, addressing includes both writing and erasing a cell. Thus where write or erase voltage pulses are applied to the cells in row electrode 1 to row electrode n in a PDP with n electrodes, it becomes more difficult to write or erase each succeeding row of cells. It is also more difficult to write or erase the cells in row electrode n relative to the cells in row electrode n−1. Likewise, the cells in row n−1 are more difficult to write or erase than the cells in row n−2, and so forth.

The problem is most noticeable in scan patterns that go from top to bottom. In this case, it is very noticeable that cells toward the bottom of the display panel or screen fail to light or erase. To eliminate this problem, many manufactures scan in an interlace pattern. This helps spread the priming or conditioning of the ionizable gas, but it is still noticeable that certain rows of cells do not write or erase as well as others.

This invention seeks to eliminate the problems discussed above regarding selective write and selective erase by scanning the rows (row electrodes) in an order or sequence that is changed from frame to frame. A frame consists of the scanning of all of the PDP row electrodes 18A (rows) in any selected sequence. In this invention, the scanning of a frame begins with a new or different row electrode used to start the scan of the preceding frame.

In the practice of this invention where there are n rows of cells to be addressed, the order of the scanning of the rows is changed sequentially from scan to scan such that the later rows to be scanned are advanced in the sequence with each subsequent scan. More particularly, rows 1 to n are scanned followed by the scanning of row 2 to row n+1 where row n+1 is original row 1, then the scanning of row 3 to row n+2 where row n+2 is original row 2, and so forth. Thus in FIG. 2, row electrodes 18A-1 to 18A-n are addressed. This is one frame. At the start of the next frame, a different row is first addressed, such as 18A-2. Original row 18A-1 becomes 18A-n+1 in the new frame.

The scanning sequence may also be advanced by skipping rows, e.g., by scanning rows 1 to n followed by the scanning of rows 3 to n+2, rows 5 to n+4, and so forth. Rows may be advanced and scanned in any order so long as each frame begins with a row different from the preceding row.

This advancing of the scanning sequence evens out the priming or conditioning of the gas in an AC gas discharge display, especially a surface discharge AC plasma display with ribs, walls, or like barriers separating rows of cells to be addressed. Such barriers are disclosed in the AC plasma display patents referenced above including U.S. Pat. Nos. 5,661,500 and 5,674,553 (Shinoda et al).

These barriers tend to prevent the flow of ionizable gas from one row of cells to another such that the priming or conditioning of the gaseous medium (and cells) in one row has little or no effect on the priming or conditioning of the gaseous medium (and cells) in other rows. This invention provides continuous and uniform priming and conditioning of all cells in all row.

Figure 3:
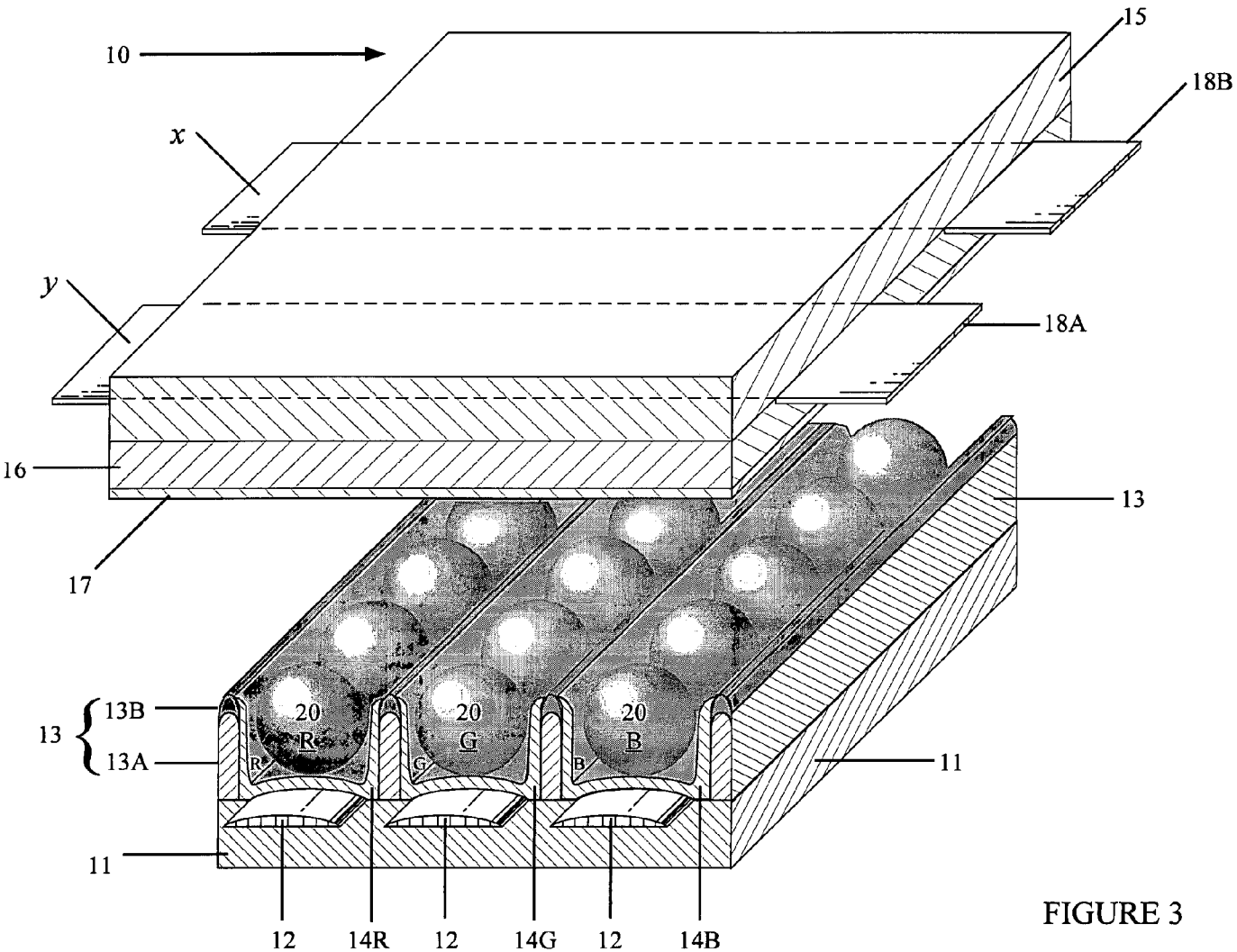
FIG. 3 shows a prospective view of an AC gas discharge (plasma) display panel with dual substrates and gas filled microspheres.

FIG. 3 shows a dual substrate surface discharge (as in FIG. 1) with gas filled microspheres 20R, 20G, and 20B and corresponding phosphor 14R, 14G, and 14B. The PDP microspheres are also called Plasma-spheres™.

Figure 4A:
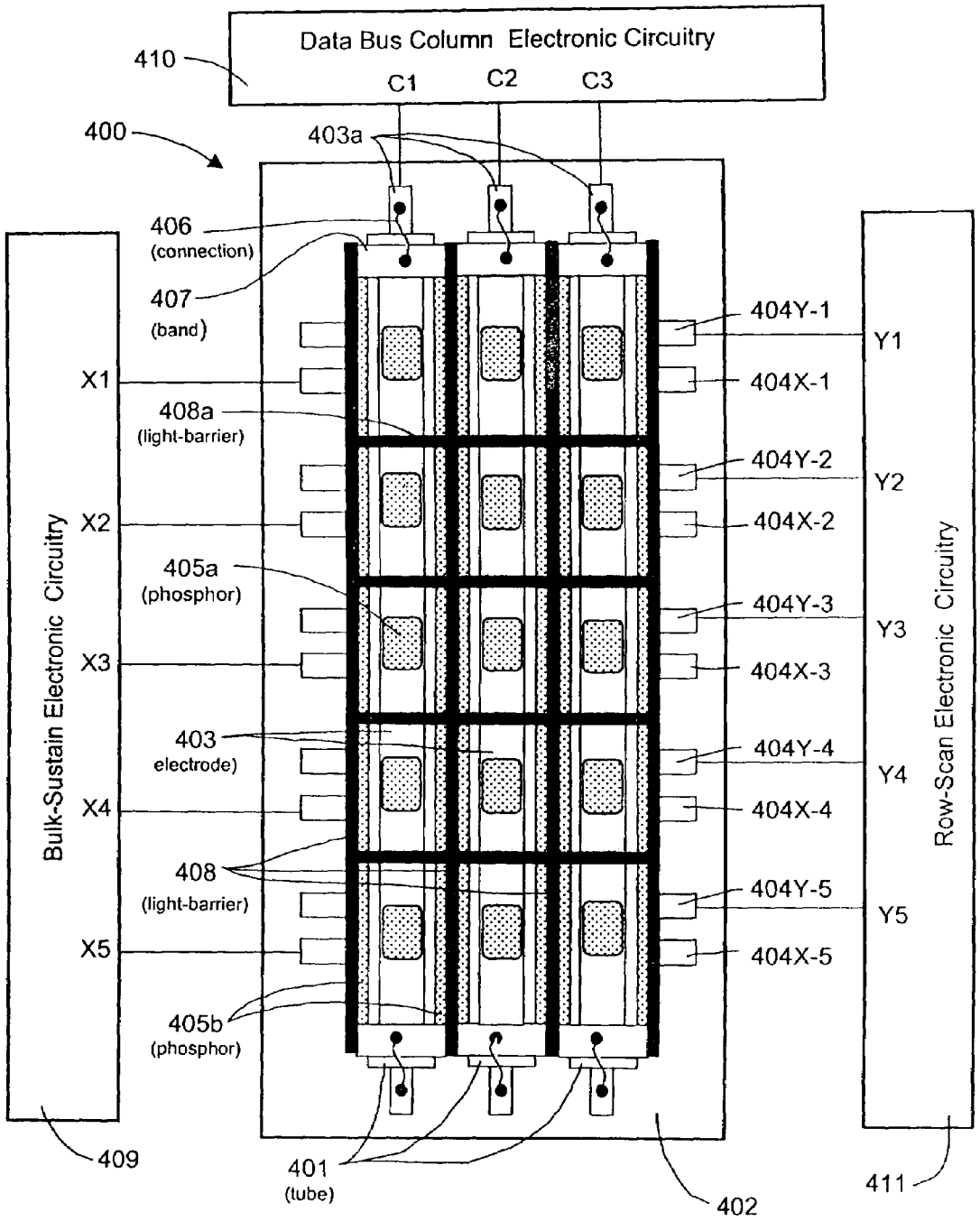
FIG. 4A shows a single substrate AC gas discharge (plasma) display panel with gas filled elongated tubes and associated electronics.
Figure 4B:
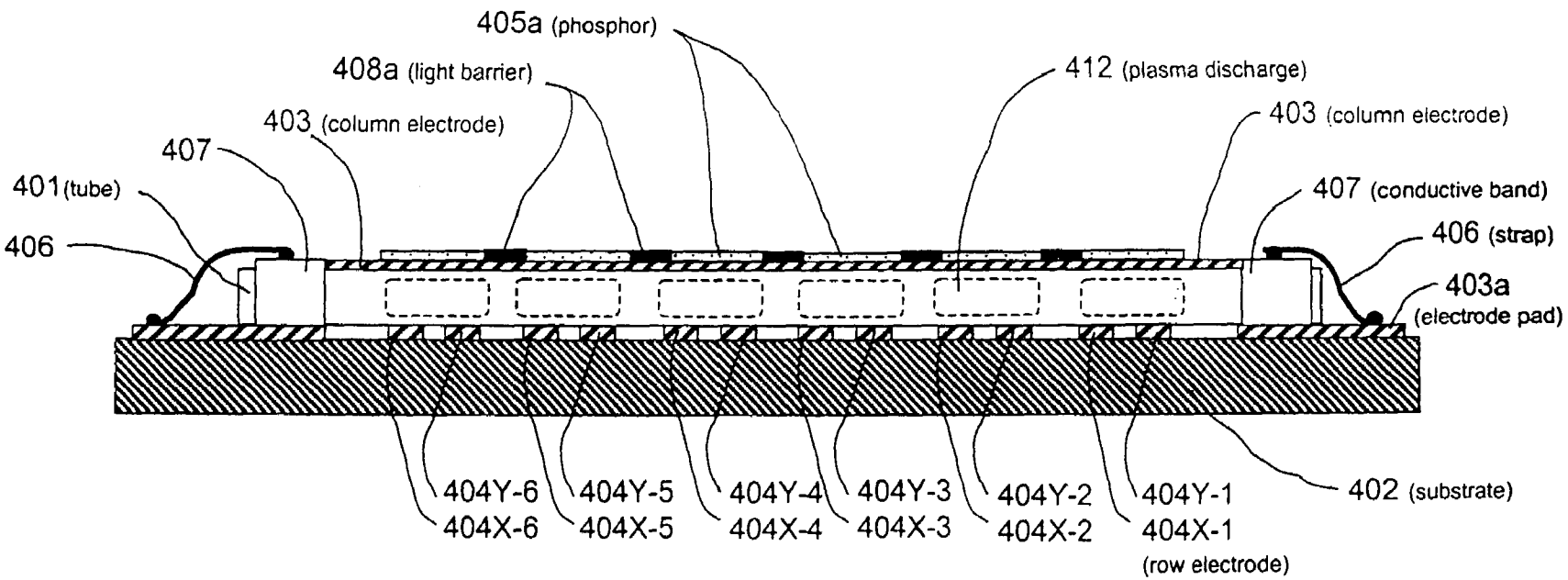
FIG. 4B is a cross sectional view of the substrate and elongated tubes of FIG. 4A.

FIGS. 4A and 4B show a single substrate surface discharge AC plasma display panel 400 with elongated gas filled tubes 401 and electronics 409, 410 and 411 arranged for surface discharge. Each column data electrode 403 is connected via conductive band 407 and conductive strap 406 to electrode pad 403*a* which is connected to electronic circuitry 410. The electrodes 404X and 404Y are connected to row scan electronics 411 and sustain electronics 409 such that once a cell discharge is initiated by the data bus electrode 403, the discharge will be sustained between the 404X and 404Y electrodes. FIG. 4B shows the gas plasma discharge 412 directly between electrodes 403 and 404 which provides UV illumination of the surrounding phosphor 405*a* and 405*b*. Also shown are substrate 402, gas filled tube 401, light barriers 408, 408*a*, and multiple gas plasma discharges 412 along the length of tube 401. The elongated gas filled tubes are also called Plasma-tubes™.

Figure 5:
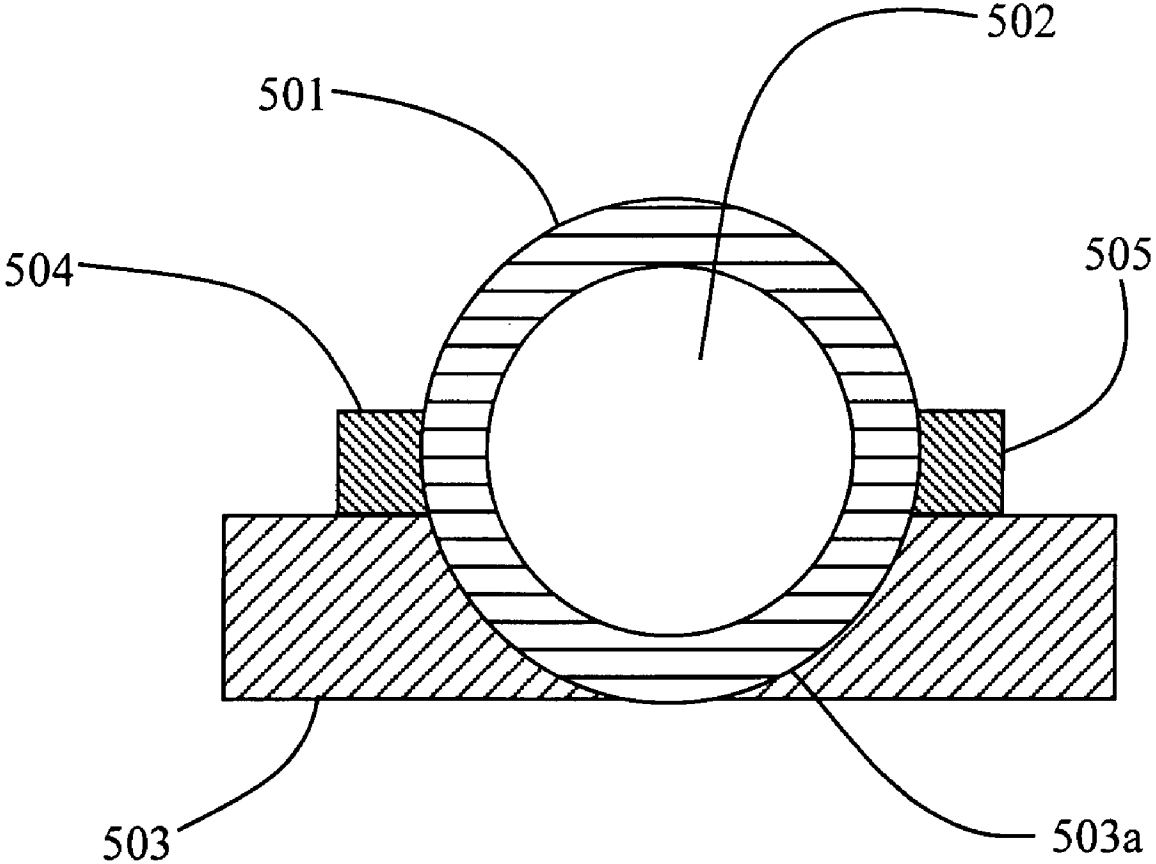
FIG. 5 shows a cross sectional view of a single substrate AC gas discharge (Plasma) display panel with microspheres.

In one embodiment of this invention, a Plasma-sphere is used as the pixel or sub-pixel element of a single substrate PDP device as shown in FIG. 5. As shown in FIG. 1, the Plasma-sphere 501 is positioned in a well 503*a* on a PDP substrate 503 and is composed of a material selected to have the properties of tranmissivity to light, while being sufficiently impermeable as to the confined gas 502. The gas 502 is selected so as to discharge and produce light in the visible or invisible range when a voltage is applied to electrodes 504 and 505. The PDP substrate 503 may be constructed of a rigid or flexible material. It may be opaque, transparent, translucent, or non-light transmitting. In the case where the discharge of the ionizable gas produces photons, a photon excitable inorganic and/or organic luminescent substance such as a photoluminescent phosphor may be applied to the exterior or interior of the Plasma-sphere 501 or embedded within the Plasma-sphere to produce light. Besides phosphors, other materials may be applied to the interior and exterior of the Plasma-sphere to enhance contrast, and/or to decrease operating voltage. One such material contemplated in the practice of this invention is a secondary electron emitter material such as magnesium oxide. Magnesium oxide is used in PDP construction to decrease the PDP operating voltages.

A standard plasma display is addressed one row at a time. The addressing of each row takes a finite amount of time. In order to maintain a flicker free image, the display must be updated at video rates. In order to achieve more rows with a plasma display, often the column electrodes are split at the center of the display and the two halves are addressed from the top and from the bottom as two independent displays. This is referred to in the PDP industry as dual scan. This invention may be practiced with or without dual scan. If dual scan is used, the PDP is more readily split into sections by using Plasma-spheres, Plasma-tubes, and/or a combination of Plasma-spheres and Plasma-tubes. As noted above, these may be of any suitable geometric cross-section or volumetric configuration including flattened or partially flattened bodies such as discs and domes.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A plasma display system comprising a plasma display panel having a grid of orthogonal electrodes with row electrodes 1 through n defining addressable cells, electronic circuitry for addressing all n rows of the cells, said addressing of all n rows comprising one frame, the addressing of the n rows of cells being in a sequence that is changed from frame to frame so as to address a different row at the beginning of each frame.

2. An AC gas discharge plasma display device comprising a display panel having a matrix of pixels arranged in n number of rows and electronic circuitry for addressing the n rows in a sequence that is changed from frame to frame so as to address a different row electrode at the beginning of each frame, one frame being the addressing of all n rows.

3. The invention of claim 2 wherein the pixels are within a plasma-tube and/or plasma-shell.

* * * * *